United States Patent [19]

Masuda

[11] Patent Number: 4,726,486

[45] Date of Patent: Feb. 23, 1988

[54] COLLAPSIBLE CONTAINER

[75] Inventor: Akira Masuda, Matsudo, Japan

[73] Assignee: Nisso Sangyo Co. Ltd., Japan

[21] Appl. No.: 931,728

[22] Filed: Nov. 14, 1986

[30] Foreign Application Priority Data

Jul. 31, 1986 [JP] Japan ..... 61-180835

[51] Int. Cl.[4] ..... B65D 21/00

[52] U.S. Cl. ..... 220/1.5; 220/6

[58] Field of Search ..... 220/1.5, 4 F, 6

[56] References Cited

U.S. PATENT DOCUMENTS

| | | | |
|---|---|---|---|
| 3,073,466 | 1/1963 | Greer et al. | 220/1.5 |
| 3,195,506 | 7/1965 | Beard | 220/6 |
| 3,618,803 | 11/1971 | Dobberkau et al. | 220/6 |
| 3,645,596 | 2/1972 | Russell-French | 220/1.5 |
| 3,796,342 | 3/1974 | Sanders et al. | 220/1.5 X |
| 4,162,737 | 7/1979 | Clive-Smith | 220/6 |
| 4,214,669 | 7/1980 | McQuiston | 220/6 |
| 4,428,491 | 1/1984 | Mittelmann et al. | 220/1.5 |
| 4,646,928 | 3/1987 | Ono et al. | 220/6 |
| 4,684,034 | 8/1987 | Ono et al. | 220/1.5 X |

*Primary Examiner*—Steven M. Pollard

*Attorney, Agent, or Firm*—McGlew and Tuttle

[57] ABSTRACT

A container for containing cargoes to be transported by a ship or the like.

Bendable right and left side plates and a vertically movable front shutter and back shutter are provided between a top plate and bottom plate so that, when the front shutter and back shutter are pulled up into the top plate and the right and left side plates are bent inward, the container will be compactly folded.

Reinforcing devices are provided respectively between the top plate and right and left side plates and between the bottom plate and right and left side plates. Shutter locking devices for locking the shutters when they are pulled down are provided respectively between the front shutter and bottom plate and between the back shutter and bottom plate. Side plate locking devices are provided against the intermediate bending parts of the right and left side plates. A pair of springs energized normally to pull up the front shutter and back shutter are provided in the directions intersecting rectangularly with the shutter moving direction within the top plate. Thus, even if a load is applied from outside, the container will not be deformed. When each shutter is pulled down, it will be able to be locked. The extending and contracting stroke of the pair of springs can be taken to be sufficient.

10 Claims, 13 Drawing Figures

COLLAPSIBLE CONTAINER

BACKGROUND OF THE INVENTION

This invention relates to a container for containing cargoes to be transported by a truck or ship from one place to the other place.

It is general to use a box-shaped container to transport cargoes to a remote place.

However, when cargoes have been transported from one place to the other, if there is no cargo in returning from the remote place, it will be wasting the space to mount the box-shaped container as it is on a truck or the like. Also, in moving a container containing no carge or in storing many containers in a storehouse or the like, if the container stands in the form of a cubic or rectangular solid, its moving operation will be difficult, a large housing space will be required, therefore the space will be wasted and many containers will not be able to be housed at once.

Therefore, such collapsible container as is disclosed in the patent gazette of Japanese Patent Laid Open No. 199443/1984 has been developed.

However, the above mentioned container has the following problems:

(A) First of all, in this container, inward bending right and left side plates are provided on both sides of a top plate and bottom plate and shutters to be housed within the top plate through springs, guide grooves and rollers are vertically movably provided on the front side and back side.

However, when the right and left side plates rise and the shutters are pulled down to be box-shaped, if an external load is applied during the transportation, this container will be likely to be deformed.

That is to say, the movable shutter is comparatively thin and bendable and the right and left side plates are pin-jointed at the upper and lower ends so that the container may be bent in the middle. Therefore, in case a pressing force is applied in the vertical, horizontal or oblique direction, for example, when a plurality of containers are piled up, a load by a downward load and horizontal rocking will be applied and the lower containers will be deformed.

(B) Second, when the above mentioned shutter is pulled down to the lowermost step to close the inlet, the self-weight of the shutter will overcome the tension of the springs and the shutter will be kept closed in the stationary state.

However, when a vibration or external load acts on the shutter during the transportation, the shutter will be likely to be pulled by the spring to open.

Even if the shutter is closed, a third person will be likely to open the shutter and to steal the cargoes within the container.

(C) Third, the right and left side plates are hinge-jointed at the upper and lower ends to the top plate and bottom plate so as to be foldable inward in the middle through the hinge parts. Therefore, in case a pressing force is applied in the vertical, horizontal or oblique direction, for example, when a plurality of containers are piled up, a load by a downward load and horizontal rocking will be applied and it will be likely that, by this load, the horizontal side plates will be broken and bent through the middle hinge parts and the lower containers will be deformed and broken.

(D) Fourth, in order to pull up the shutter into the top plate, a spring is arranged in the same direction as the shutter moving direction and is connected with the shutter in the lower part through a wire.

However, when this spring is provided within the top plate, as the setting space within the top plate is restricted and the spring is directed in the same direction as the shutter moving direction, the stroke of the spring will not be able to be sufficiently taken. Therefore, there will be a defect that the shutter will not be pulled up completely.

(E) Fifth, as the above mentioned shutter is made by connecting many panels, gaps will be inevitably formed in the panel connecting parts in working and there will be a problem that rainwater will enter the container through such gaps.

SUMMARY OF THE INVENTION

Therefore, a primary object of the present invention is to prevent the container from being deformed by any load applied from outside. Another object of the present invention is to positively lock the shutter when it is pulled down. Another object of the present invention is to sufficiently take the extending stroke of the spring pulling up the shutter. A further object of the present invention is to prevent rainwater and the like from coming in even if there is a gap between the panels forming the shutter.

In order to attain the above mentioned objects, the present invention is the formation of a collapsible container provided with bendable right and left side plates and vertically movable front and back shutters between a top plate and bottom plate characterized in that reinforcing devices are removably provided respectively between the top plate and right and left side plates and between the bottom plate and right and left side plates, shutter locking devices are removably provided respectively between the front shutter and bottom plate and between the back shutter and bottom plate, side plate locking devices are removably provided respectively as opposed to the bending parts of the right and left side plates and a pair of springs energized in the directions reverse to each other and directed in the directions intersecting rectangularly with the shutter moving direction are provided within the top plate so that the shutters are always pulled toward the top plate with said pair of springs.

The operation by the above mentioned formation is as follows:

When an external load acts, the reinforcing devices and side plate locking devices will operate to prevent the container from being deformed and, when the shutter is pulled down, the shutter will be held to the bottom plate by the shutter locking device and the springs will always pull the shutter upward.

DESCRIPTION OF THE PREFERRED EMBODIMENT

An embodiment of the present invention shall be described in the following with reference to the drawings.

Figure 1:
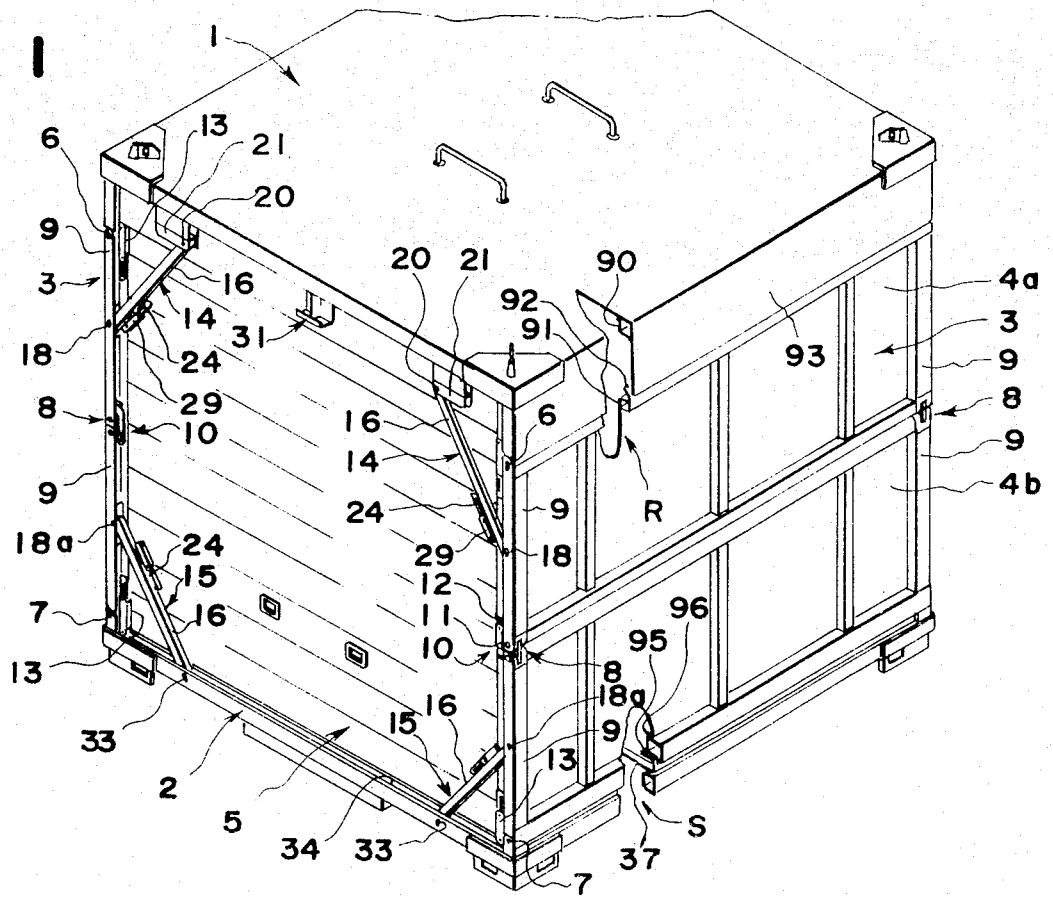
FIG. 1 is a perspective view of a container embodying the present invention.
Figure 2:
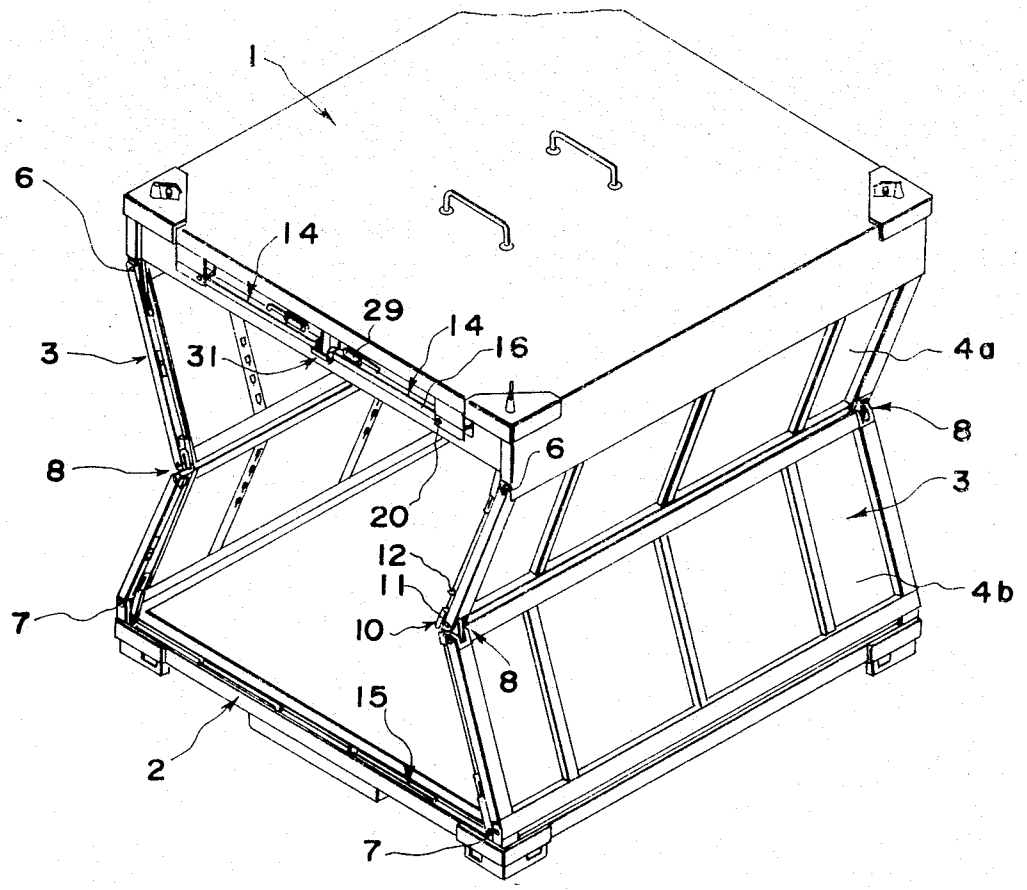
FIG. 2 is a perspective view showing the container as folded.

As shown in FIGS. 1 and 2, a container using braces forming reinforcing devices is cubically formed of a top plate 1, a bottom plate 2, bendable right and left side plates 3, 3 and front and back shutters 5, 5.

Each of the right and left side plates 3, 3 consists of two upper and lower rigid plates 4*a* and 4*b*. The upper plate 4*a* is rotatably connected to the top plate 1 through hinge parts 6 and the lower plate 4*b* is rotatably connected to the bottom plate 2 through hinge parts 7 in the same manner. Further, the two upper and lower plates 4*a* and 4*b* are hinge-jointed with each other through middle hinge parts 8, 8 so as to be folded inward through the middle hinge parts 8, 8.

The front shutter 5 and back shutter 5 are inserted on both sides into guide grooves provided in frames 9 of the right and left side plates 3, 3 and are vertically movably guided through rollers. The front shutter 5 will be raised when a cargo is to be contained in the container and will be pulled down and locked on the bottom plate 2 side when the container is to be transported.

In case the container is to be folded, the front shutter 5 and back shutter 5 will be pulled up and housed within the top plate 1 and, as shown in FIG. 2, the right and left side plates 3, 3 will be bent inward through the middle hinge parts 8 and upper and lower hinge parts 6 and 7.

The front and back shutters 5, 5 are normally energized in the pulling-up direction by springs provided within the top plate 1 so as to be pulled by the springs to the top plate 1 side and to rise as guided by the rollers and guide grooves when the shutters are to be opened.

Locking mechanisms 10, 10 are provided respectively adjacently to the middle hinge parts 8, 8 of the right and left side plates 3, 3 and each consists of a case 11 and a wedge 12 so that, when the wedge 12 is struck into the case 11, the hinge part 8 will be locked and, even if an external force acts, the hinge part 8 will not be broken or bent.

Sealing devices 13 are provided above and below the jointing parts of the front and back shutters 5, 5 with the right and left side plates 3, 3 to prevent the entry of rainwater and the like.

Shutter locking devices are provided respectively as opposed to the shutters 5, 5 in the end parts of the bottom plate 2 so that, when the shutters 5, 5 are pulled down, the shutters 5, 5 will be held through these locking devices and, when the locking devices are released, the shutters 5, 5 will be pulled up by the springs within the top plate.

Upper reinforcing devices 14, 14 are removably provided between the top plate and right and left side plates 3, 3 and lower reinforcing devices 15, 15 of the same structure are likewise provided between the bottom plate 2 and right and left side plates 3, 3.

The upper and lower reinforcing devices 14 and 15 are formed of extendable braces.

Figure 3:
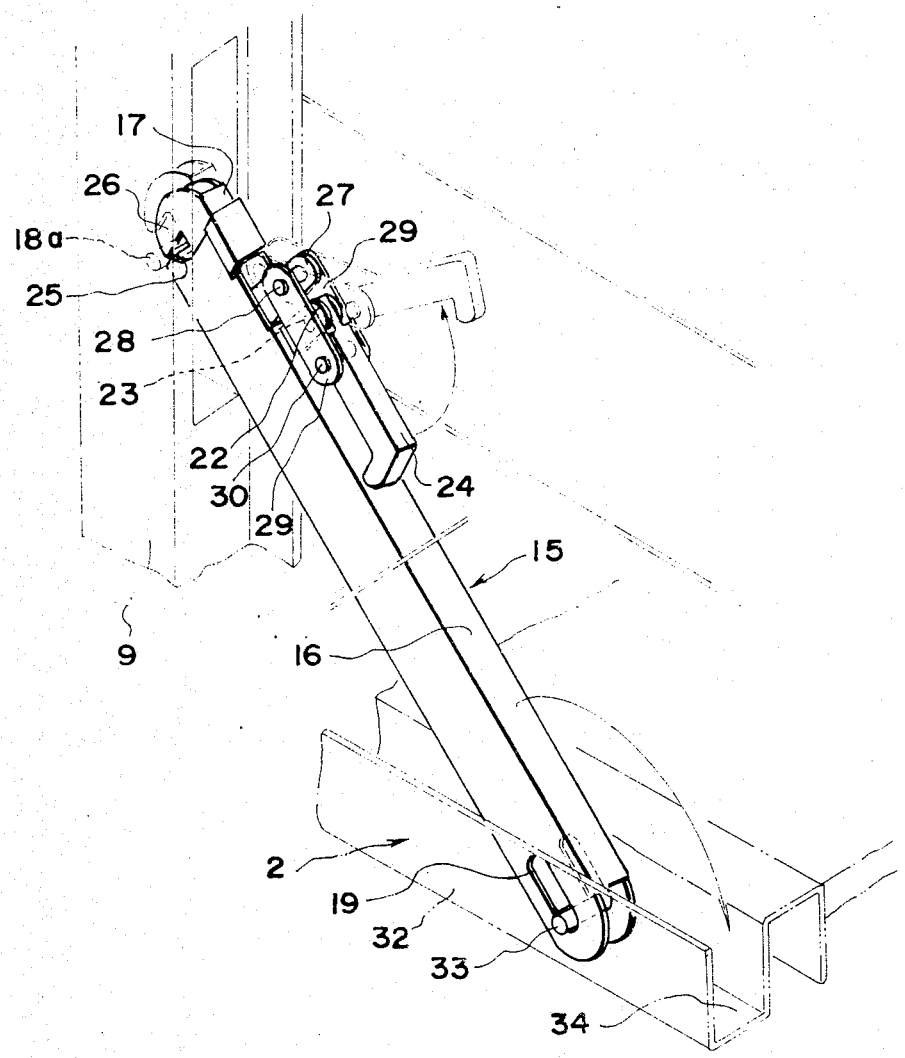
FIG. 3 is a perspective view of a lower brace.

As shown in FIGS. 1 and 3, the upper and lower braces consist respectively of hollow long frames 16 and locking frames 17 extendably inserted into these long frames 16, are pivoted respectively at the base ends to the top plate 1 and bottom plate 2 and can be removably hung respectively at the other ends on pins 18 and 18*a* provided on frames 9, 9 of the right and left side plates 3, 3.

A slot 19 is formed in the longitudinal direction on the base end side of the long frame 16. Shafts 20 and 33 are movably inserted in this slot 19. This shaft 20 is connected to a yoke-shaped supporting frame 21 fixed to the front surface of the top plate 1. The shaft 33 is fixed to a groove frame 32 of the bottom plate 2. Thereby, the long frame 16 of the upper brace can move by the length of the slot within the supporting frame 21 and can rotate with the shaft 20 as a center. The long frame 16 of the lower brace can move likewise vertically by the length of the slot 19 and can rotate with the shaft 33 as a center.

An opening part 16*a* is formed on the tip side of the long frame 16. A bracket 22 rises in a position adjacent to this opening part 16*a*. A handle 24 is rotatably pivoted at the tip to this bracket 22 through a shaft 23. Further, a curved pin locking part 25 is formed in the lower part of the tip of the long frame 16.

On the other hand, the locking frame 17 is made of a plate or a yoked plate and a hook 26 is formed as opposed to the pin locking part 25 at the tip of the locking frame 17.

A bracket 27 rises in the upper part near the tip of the locking frame 17, projects above the opening part 16*a* of the long frame 16 and can move in the longitudinal direction within the range of the opening part 16*a*.

Two links 29 are pivoted each at one end to the bracket 27 through a shaft 28 and at the other end to the handle 24 through a pin 30.

Therefore, when the handle 24 is rotated in the direction of the hook 26 with the shaft 23 as a fulcrum, the links 29 will rotate in the same direction with the pin 28 as a center as operatively connected with the handle 24. At this time, the bracket 27 will be pushed toward the tip to push out the locking frame 17 and, as a result, the total length of the long frame 16 and locking frame 17 will become longer. On the other hand, when the handle 24 is rotated in the reverse direction from this state, the bracket 27 and locking frame 17 will be retreated and the length of the brace will become shorter.

The upper brace receiving member 31 is provided in the middle of each of the front and back surfaces of the top plate 1 so that, when the use of the brace is stopped, the hook 26 will be hung on this receiving member 31. When the brace is to be used, the long frame 19 will be retreated through the slot 19, the hook 26 will be removed from the receiving member 31, then the long frame 16 will be rotated downward with the shaft 20 as a center and further the handle 24 will be rotated to pull out the locking frame 17 and to oppose the hook 26 to the pin 18 of the frame 9.

When the handle 24 is then rotated to the original position, the locking frame 26 will be pulled into the long frame 16, the length of the brace will become shorter, at the same time, the hook 26 will be hung on the pin 18 and the pin 18 will be held by the hook 26 and pin locking part 25.

Therefore, two upper braces are mounted obliquely between the top plate 1 and right and left side plates 3, 3 to reinforce both. Thus, even if a vertical, horizontal or oblique load is applied to the top plate 1 and right and left side plates 3, 3, the container will not be deformed. In the same manner, as lower reinforcing devices 15, the lower braces are mounted obliquely in the corners of the bottom plate 2 with the right and left side plates 3, 3.

That is to say, the structure of the lower brace is exactly the same as in the above mentioned case and the brace is pivoted at the base end through a shaft 33 within a groove frame 32 provided in the end part of the bottom plate 2 so that this brace will be housed within the groove 34 of the groove frame 32 when it is not used but will be rotated upward to engage with the pin 18*a* of the frame 9 to reinforce the bottom plate 2 and right and left side plates 3, 3.

The shutter 5, shutter 5 pulling-up mechanism and shutter 5 locking device shall be explained in the following with reference to FIGS. 4 to 9.

Figure 9:
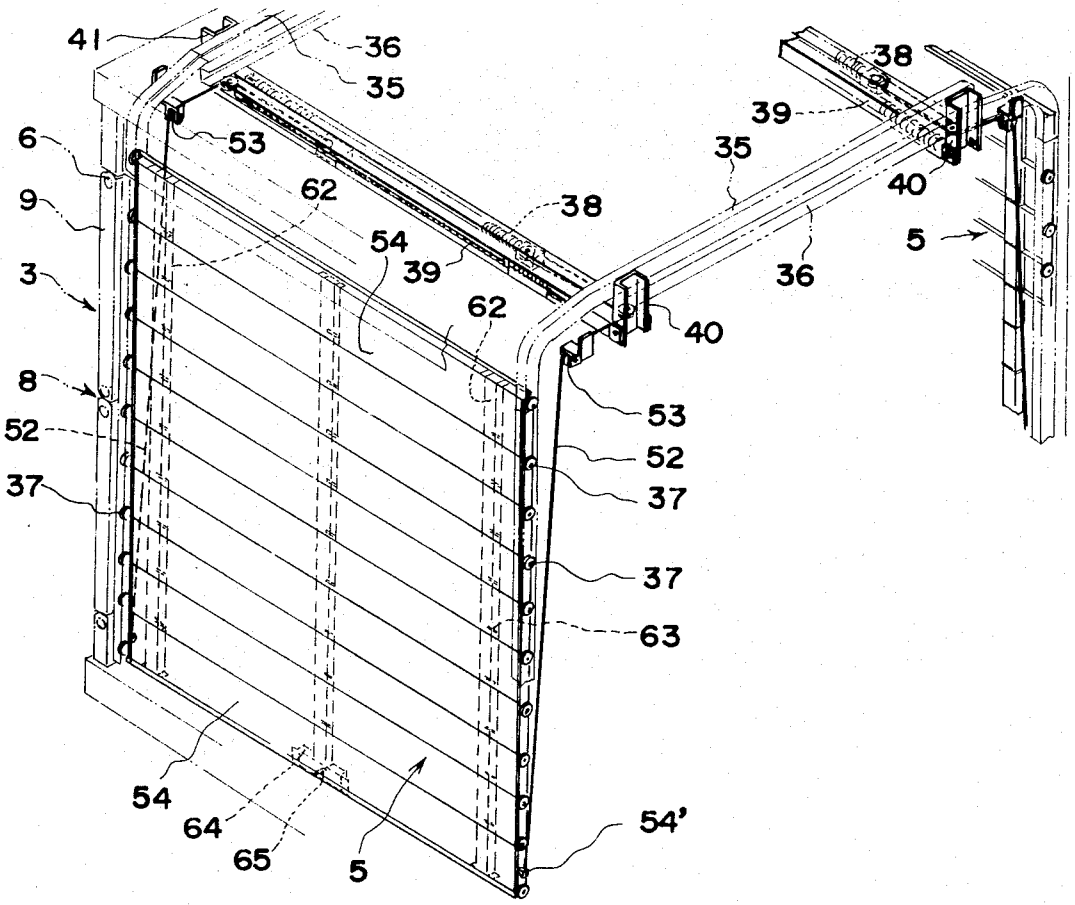
FIG. 9 is a partly cut perspective view of a mechanism for pulling up the shutter.

First of all, the connecting relation of the shutter and spring shall be explained with reference to FIG. 9.

On both right and left sides of the top plate 1, pairs of guide grooves 35, 35 and 36, 36 are respectively provided in the front and back shutter 5 entering directions, these guide grooves 35 and 36 extend to the frames 9, 9 of the right and left side plates 3, 3 and rollers 37 are fitted in these guide grooves 35 and 36. Therefore, the shutters 5, 5 will vertically move along the guide grooves 35 and 36 through the rotatable rollers 37, 37. When the shutters 5, 5 are pulled up into the top plate 1, the shutters 5, 5 will be housed within the guide grooves 35 and 36 and will be held as they are by spring forces.

Pairs of springs 38 and 39 are provided respectively on the front surface side and back surface side within the top plate 1. The front surface side springs and back surface side springs are of the same structure and therefore the front surface side springs 38 and 39 shall be described.

The pair of springs 38 and 39 are energized in the directions reverse to each other. The respective springs 38 and 39 are directed in the directions intersecting rectangularly with the shutter 5 moving direction or, in other words, in the direction intersecting rectangularly with the guide groove 35, 36 extending direction.

Figure 6:
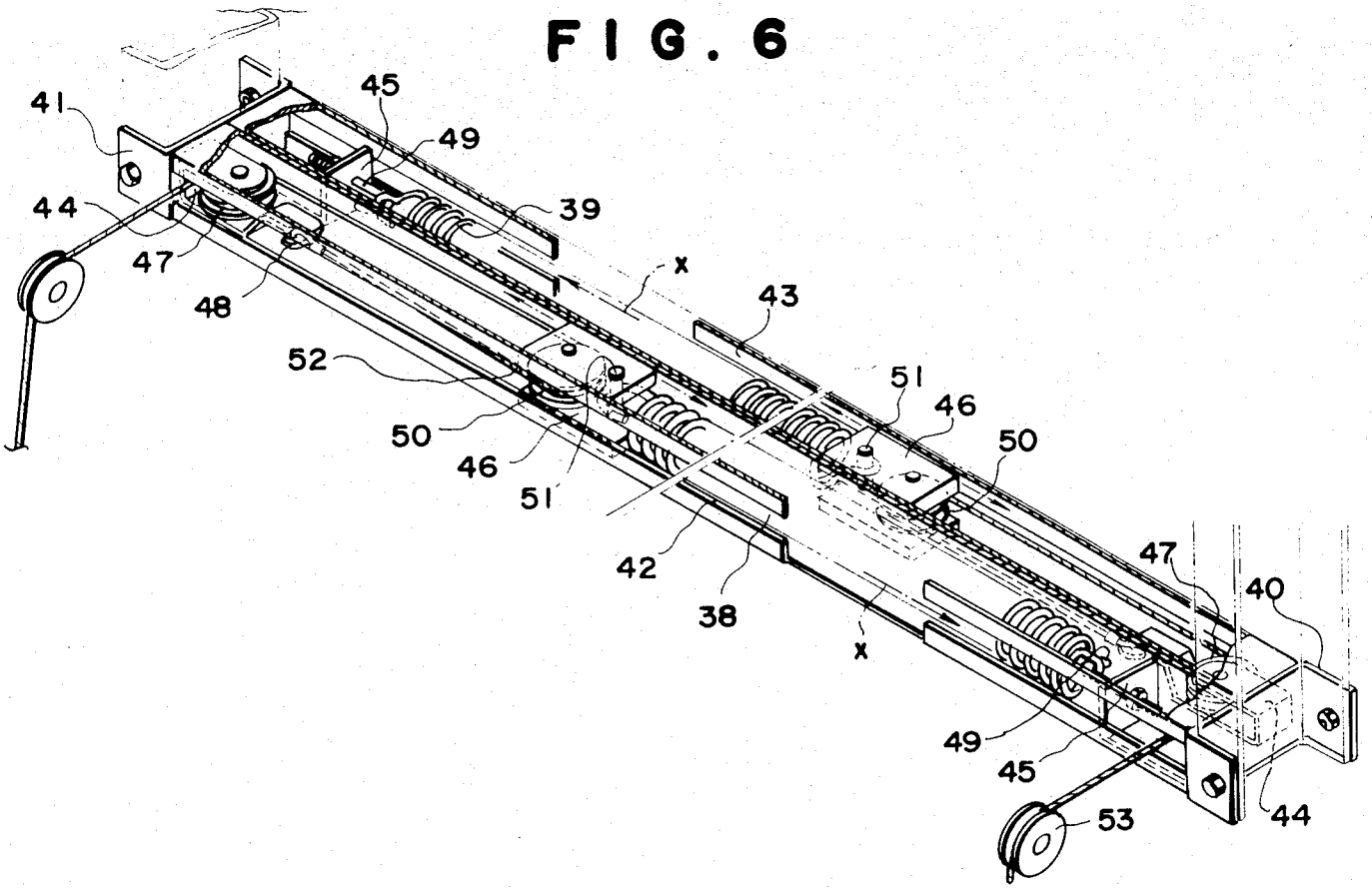
FIG. 6 is a perspective view of springs.

More particularly, brackets 40 and 41 are fixed to both sides of the top plate 1, parallel spring guides 42 and 43 are provided between these brackets 40 and 41 and the springs 38 and 39 are extendably inserted respectively into these spring guides 42 and 43 (FIG. 6).

Sheave brackets 44, 44 and spring receiving brackets 45, 45 are fitted inside the respective brackets 40 and 41. Sliding members 46, 46 are slidably inserted into the respective spring guides 42 and 43.

A sheave 47 is rotatably supported in each sheave bracket 44 and is provided at the end with a hook 48. A length adjustable hook 49 is connected to each spring receiving bracket.

Further, a sheave 50 is rotatably supported in each sliding member 46 and a locking pin 51 is fixed to the other end of the sliding member 46.

The respective springs 38 and 39 ae provided between the locking pin 51 and hook 49 and are compressed in the directions reverse to each other, that is, in the directions indicated by the arrows to pull the sliding members 46 in the directions indicated by the arrows.

A wire 52 is connected at one end to each hook 48, is wound on the sheaves 50 and 47, is futher wound on another sheave 53 provided near the end of the top plate 1 and is then connected to a bracket 54' protruded on both sides of the lower part of the shutter 5.

Therefore, when the springs 38 and 39 are compressed in the directions X, each wire 52 will be pulled in the same direction through the sheaves 50, 47 and 53 and thereby the shutter 5 will be pulled up successively into the top plate 1 from below. However, as each wire 52 wound on the sheave 47 returns again toward the sheave 47 through the sheave 50 and is connected to the hook 48, the wire 52 will move by twice the stroke of the sliding member 46 and springs 38 and 39 and, as a result, the shutter will be pulled up by twice as much.

Further, as the directions of the springs 38 and 39 intersect rectangularly with the guide grooves 35 and 36 and do not interfere with the shutter 5 moving direction, the stroke of the springs 38 and 39 will be able to be sufficiently taken.

The structures of the shutters 5, 5 shall be described in the following. However, the front shutter 5 and back shutter 5 are of the same structure. Therefore, only the front shutter 5 shall be explained.

The shutter 5 is formed by connecting many panels.

Figure 4:
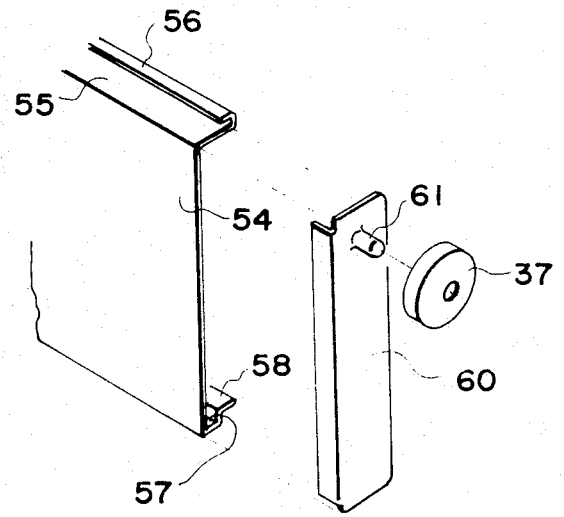
FIG. 4 is a perspective view of a panel as disassembled.
Figure 5:
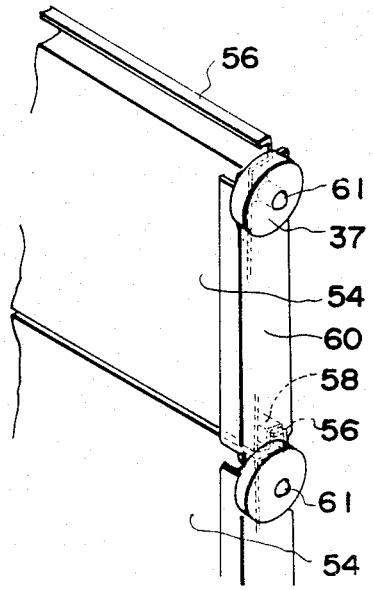
FIG. 5 is a partly cut perspective view of the panel.

As shown in FIGS. 4 and 5, the panel 54 consists of a frame channel-shaped in the cross-section and provided at the upper end with a horizontal surface 55 and a channel-shaped groove frame 56 in the longitudinal direction and at the lower end with a channel-shaped groove 57 and a horizontal plate 58.

A pressing panel 60 is contacted and fixed to each end of the panel 54 and a roller 37 is rotatably supported in the upper part of this pressing panel through a shaft 61.

The respective panels 54 are arranged in the vertical direction and are respectively connected with each other so as to be foldable by any angle to be vertically movable along the guide grooves 35.

Figure 7:
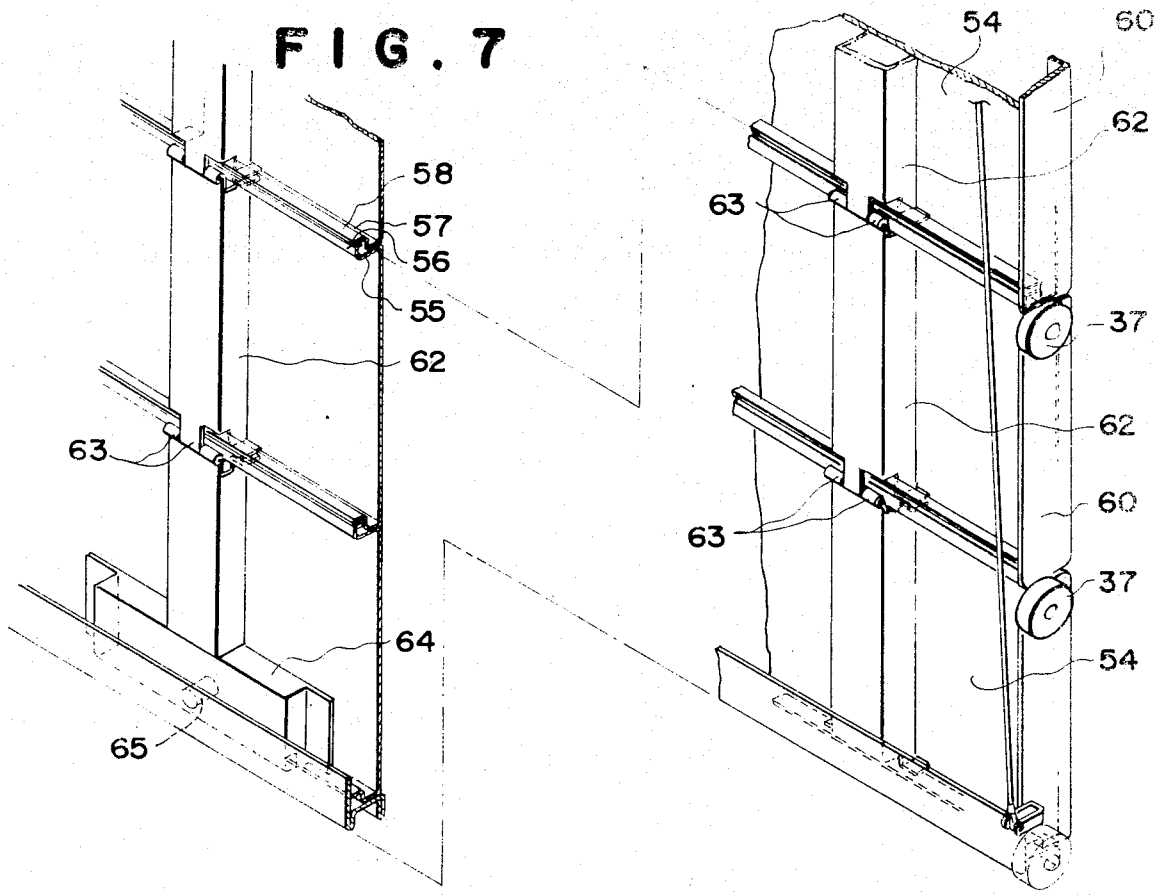
FIG. 7 is a partly cut perspective view of a shutter as seen from the back.
Figure 8:
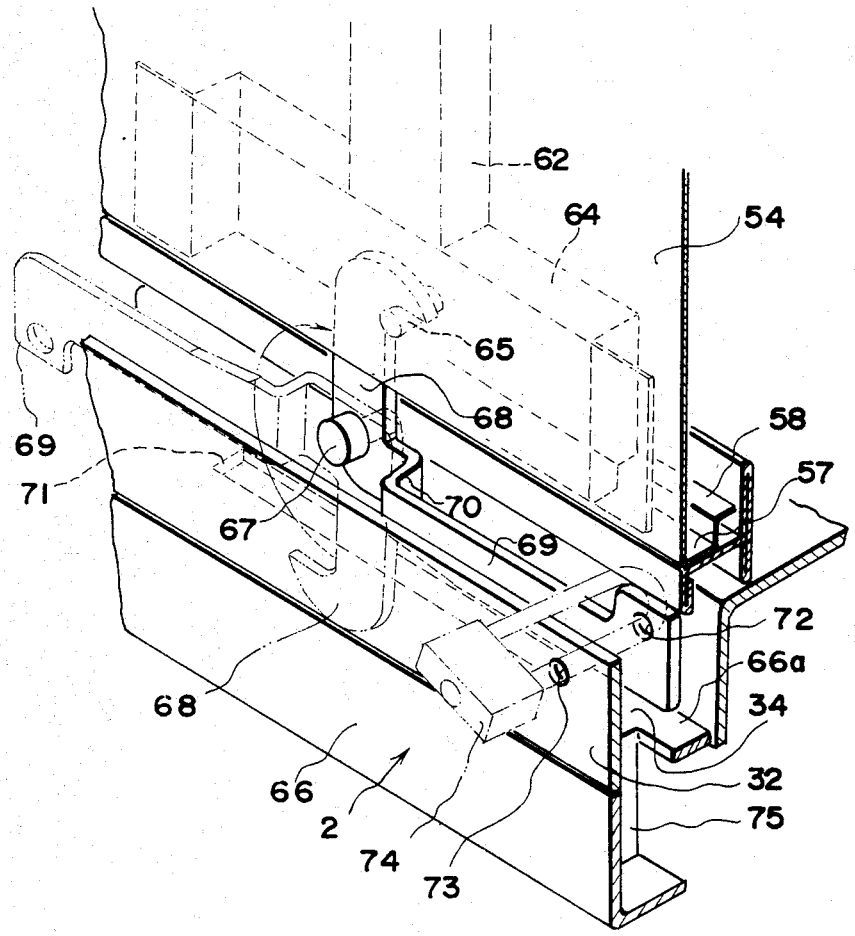
FIG. 8 is a perspective view of a shutter locking device.

That is to say, as shown in FIG. 7, hollow reinforcing members 62 are hinge-jointed in the vertical direction on the back of the respective panels 54 foldably with each other through hinges 63 so as to be bendable through the hinges 63.

In the respective panels 54, the groove frame 56 of the lower panel 54 is opposed to the lower surface of the horizontal plate 58 of the upper panel 54 and the horizontal surface 55 of the lower panel 54 is contacted with the lower surface of the channel-shaped groove 57 of the upper panel 54 to continuously joint the respective upper and lower panels with each other so that the shutter 5 may be kept air-tight in the position of jointing the lower surface of the groove 57 and the upper surface of the horizontal surface 55 with each other.

In such case, as the channel-shaped groove frame 56 is opposed to the above mentioned jointing position, even if rainwater comes in through a slight gap in the jointing position from outside the shutter 5, this rainwater will be stopped by the groove frame 56 for intercepting rainwater and will be prevented from further entering the container.

Further, even when the shutter 5 is housed within the top plate 1 and is held horizontally by the guide grooves 35, the groove frames 56 will be vertical and rainwater remaining within the groove frames 56 will not drop downward.

The shutter locking device shall be described in the following. A thick reinforcing member 64 is fixed in the middle on the back of the panel 54 in the lowermost step. A locking pin 65 is passed through the middle of this reinforcing member 64 to project at one end out of the shutter 5.

On the other hand, a groove frame 32 having a groove 34 formed therein is provided at the end of each of the front surface and back surface of the bottom plate 2. A box 66 is fitted in the middle of the lower part of this groove frame 32. A hook 68 is rotatably borne through a shaft 67 is the middle of the inner wall of the groove 34 of the groove frame 32. A handle 69 extending in the rectangular direction is integrally connected to the lower base end of this hook 68 so that the hook 68 may be engaged or disengaged with the locking pin 65 by rotating the handle 69.

When the hook 68 engages with the locking pin 65, even if the shutter 5 is pulled upward by the springs 38 and 39, the shutter will not be able to move and will be locked but, when the hook 68 is disengaged with the locking pin 65, the shutter 5 will will be moved upward along the guide grooves 35 and 36 by the tension of the springs 38 and 39 to open the inlet of the container.

The jointing part 70 of the handle 69 with the hook 68 may be straight but may be preferably bent to be L-shaped as illustrated, because, when the handle 69 is to be rotated within the groove 34, if the handle 69 is positioned in the middle of the groove 34, the handle 69 will be able to be smoothly rotated without interfering with the groove frame 32.

A slot 71 is formed as opposed to the hook 68 in the middle of the upper surface of the box 66 so that, when the hook 68 is rotated, it will not interfere with the upper surface 66*a* of the box 66.

However, if this slot 71 is formed, rainwater will enter the box 66. Therefore, a hole 75 is formed on the back of the box 66 to be able to discharge water out of the box 66.

When the hook 68 engages with the locking pin 65, the hook 68 and handle 69 will be in the position indicated by the solid lines but, when the hook 68 is disengaged, the handle 69 will rotate by 180 degrees counterclockwise to be moved to the position indicated by the dotted lines. At this time, the hook 68 will also rotate by 180 degrees and will be housed within the box 66 through the slot 71.

A locking hole 72 is formed in the end part of the handle 69. A locking hole 73 corresponding to this locking hole 72 is also formed in the groove frame 32. A lock 74 or the like is inserted through both locking holes 72 and 73 so that, when the shutter 5 is locked, it will be prevented from being unlocked by an external force or any other cause.

Figure 11:
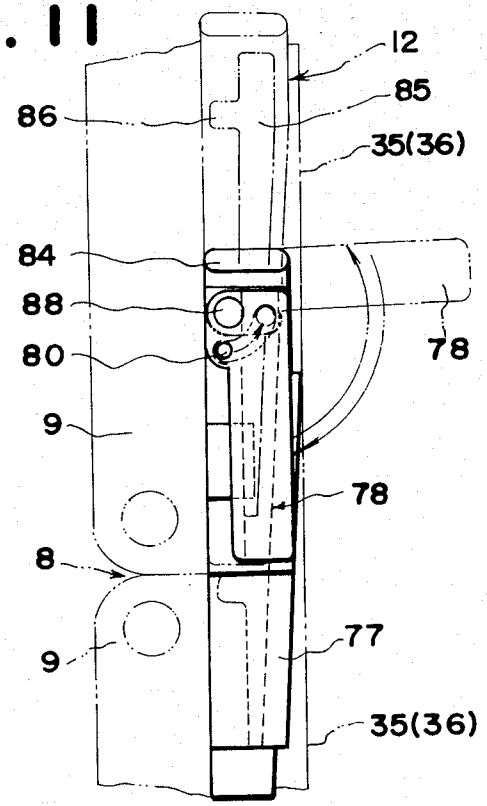
FIG. 11 is a front view of the side plate locking device.
Figure 10:
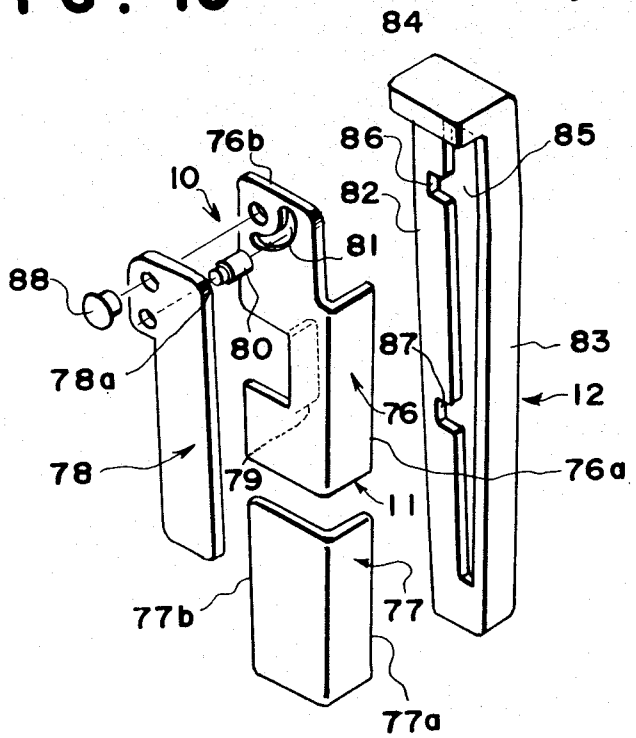
FIG. 10 is a perspective view of a side plate locking device as disassembled.

As shown in FIGS. 10 and 11, the locking device 10 comprises a case 11 consisting of two upper and lower guide cases 76 and 77, a wedge 12 to be inserted into the case 11 and a handle 78 to control the wedge 12.

The guide cases 76 and 77 are formed of frames L-shaped in the cross-section. The upper guide case 76 is cut out in the middle and has the cut piece 79 raised to guide the wedge 12.

The guide cases 76 and 77 are secured as by welding to the frames 9, 9 of the right and left side plates 3 as opposed to the hinge parts 8, 8 so that the wedge 12 may be vertically inserted.

So long as the guide cases 76 and 77 guide the wedge vertically, they may be channel-shaped in the cross-section or may be hollow square tubes.

A handle 78 is pivoted at the upper end to the upper guide case 76 through a shaft 88. A locking pin 80 provided on the handle 78 is movably inserted in a curved slot 81 formed in the guide case 76.

The wedge 12 has a vertical surface 82 and tapered surface 83 formed on the sides and a flange 84 formed at the upper end and also has a vertical groove 85 formed in the middle. This groove 85 communicates with two upper and lower locking grooves 86 and 87 cut horizontally. The cut piece 79 is inserted in the groove 85. Further, a locking pin 86 is selectively fitted in the groove 85 and locking frooves 86 and 87.

As shown in FIG. 11, the shutter 5 guides 35 and 36 are provided on the frames 9, 9 so as to project inward. The vertical pieces 76*a* and 77*a* respectively of the guide cases 76 and 77 are welded on the end surfaces to the front surfaces of the guides 35 and 36. The horizontal pieces 76*b* and 77*b* are vertically fixed on the end surfaces to the inside surfaces of the frames 9, 9. The two guide cases 76 and 77 are somewhat inclined downward. The guide cases 76 and 77 are inclined because the wedge 12 has a tapered surface and in order to oppose the vertical surface 82 of the wedge 12 and the end surfaces of the horizontal pieces 76*b* and 77*b* vertically to the frames 9, 9.

In case the container is to be raised to be box-shaped, the plates 4*a* and 4*b* of the right and left side plates 3, 3 are raised through the hinge parts 8, 8.

When the wedge 12 is inserted into the guide cases 76 and 77 in this state, the wedge 12 will lower as guided by the groove 85 and locking pin 80. When the wedge 12 is struck on the flange 84 with a hammer or the like to be fastened and then the handle 78 is rotated counterclockwise in FIG. 11, the locking pin 80 will fit in the locking groove 86 to prevent the wedge 12 from being removed.

Therefore, even if a load is applied to the container and the frames 9, 9 tend to be curved inward through the hinge parts 8, 8, as the inside surfaces of the frames 9, 9 contact the vertical surface 82 of the wedge 12 and the two guide cases 76 and 77 are locked with the sedge 12 and can not be divided, as a result, the frames 9, 9 will not be able to be bent and will be able to remain vertical and the container will be able to be prevented from being deformed.

Then, in unlocking, when the handle 78 is rotated counterclockwise, the upper end corner part 78*a* of the handle 78 will contact the flange 84 of the wedge 12 and will slightly push up the wedge 12 and therefore the wedge 12 will be pushed up with a comparatively small operating force and then will be lightly pulled up by hand out of the guide cases 76 and 78. When the wedge 12 has been pulled up to the uppermost part, of the handle 78 is again rotated clockwise, the locking pin 80 will fit in the lower locking groove 87 and therefore the wedge 12 will be prevented from dropping out of the case 11.

On the other hand, when the wedge 12 is pulled up, the two upper and lower guide cases 76 and 77 will be able to be divided and therefore, even if the frames 9, 9 are folded through the hinge parts 8, 8 to fold the container, the frames 9, 9 will not interfere with the case 11 and wedge 12 and will be able to be smoothly bent.

Ventilating devices R and S are provided respectively between the right and left side plates 3, 3 and top plate 1 and between the right and left side plates 3, 3 and bottom plate 2.

Figure 12:
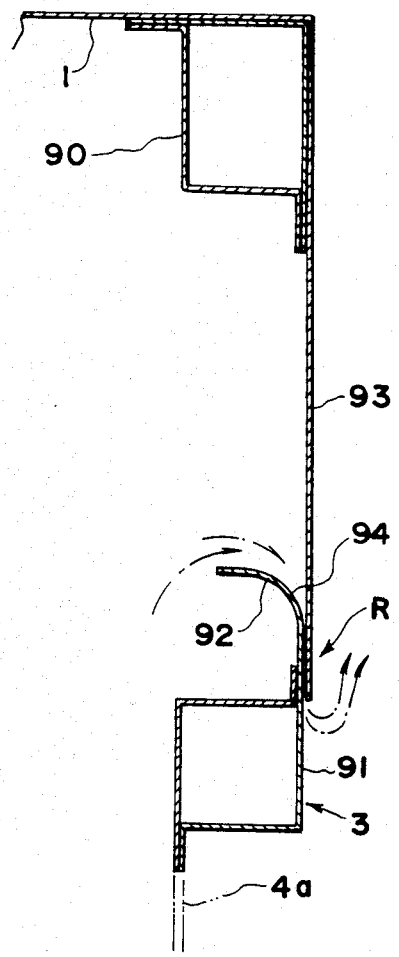
FIG. 12 is a magnified sectioned view of a ventilating device provided between the top plate and right side plate.

FIG. 12 shows a magnified sectioned view of a ventilating device in the upper part R of the right and left side plates 3, 3.

The top plate 1 has a shielding plate 93 suspended from a frame 90.

On the other hand, a horizontal hollow square tubular frame 91 is provided on the upper plate 4a of the right and left side plates 3. A rainwater entry preventing plate 92 rising upward from the frame 91 and curved inward at the upper end is opposed to the inside of the shielding plate 93 through any clearance 94.

The clearance 94 has an outer inlet positioned below an inner outlet and is formed to be L-shaped in the cross-section so as to be curved inward, that is, leftward in the drawing from the lower inlet.

The plate 92 is curved in the upper part in order to prevent the upper plate 4*a* from interfering with the shielding plate 93 when the upper plate 4*a* is folded inward through the hinge parts 8.

The shielding plate 93 is suspended from above to oppose and lap the outside of the plate 92, has the outer inlet of the clearance 46 below and therefore prevents rainwater falling from above from coming in.

Air heated within the container will be discharged as indicated by the arrows out of the clearance 94.

Figure 13:
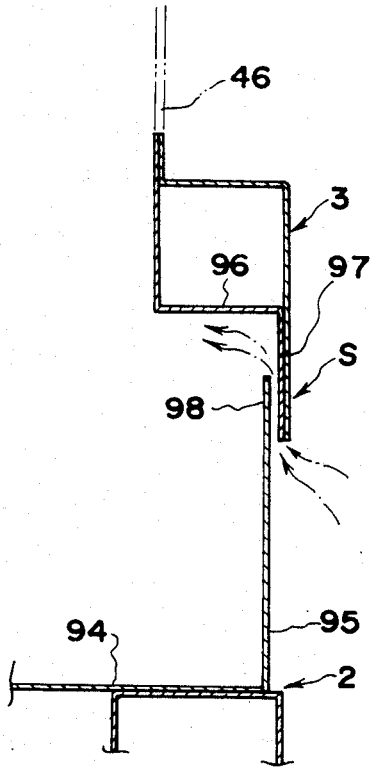
FIG. 13 is a magnified sectioned view of a ventilating device provided between the bottom plate and right side plate.

FIG. 13 shows a ventilating device in the lower part S of the right and left side plates 3, 3.

An upward rising shielding plate 95 is provided at the outer end of a supporting plate 94 of the bottom plate 2.

On the other hand, a hollow square tubular frame 96 is provided below in the lower plate 4*b* in the right and left side plates 3, 3. A downward extending shielding plate 97 is provided on this frame 96 and is opposed to the outside of the shielding plate 95 in the bottom plate 2 through a clearance 98.

Therefore, the clearance 98 has an outer inlet positioned below an inner outlet and is formed to be L-shaped in the cross-section so that rainwater falling from above may be intercepted by the shielding plates 95 and 97 through the clearance 98.

External air will come into the container as indicated by the arrows through the clearance 98, will cool the interior of the container and then will be discharged out through the clearance 94 of the upper ventilating device R.

As in the above, according to the present invention, there are the following effects:

(A) First of all, as the reinforcing devices are provided, there are the following effects:

As the braces are provided in four corners respectively between the top plate and right and left side plates and between the bottom plate and right and left side plates, even if a vertical load is applied to the container, the load will be carried by the braces and the container will be prevented from being deformed.

As the brace is removable at one end, when the front and back shutters are to be opened or when the shutters are to be opened and the right and left side plates are to be folded, the braces will be able to be removed.

(B) Second, the brace is used as a reinforcing device: Due to the structure of the brace, there are the following effects:

As the locking frame is extendably inserted in the long frame, the length in the setting position of the brace can be freely adjusted.

As the brace can be driven to extend or contrace by the handle operation, the operability is high. In other words, the operating force may be small and the speed can be elevated.

As the locking frame is provided with the hook, when in use, the hook will be hung on the pin and, when not in use, the hook will be able to be removed from the pin and therefore the brace itselt will not be in the way.

As the long frame and locking frame are connected with each other through the link and handle, a brace in which the respective component parts are not irregular but are standardized can be obtained.

(C) Third, as the shutter locking device is provided, when the shutter is pulled down, even if it is pulled upward by the springs, the shutter will be positively locked not to open. According to the working mode of the locking device, there are the following effects:

When the handle is rotated in one direction, the hook will engage with the locking pin. Therefore, even if the shutter is energized with a pulling-up force, the shutter will be locked not to open.

As the locking device can be locked or unlocked by the handle operation, the operability is high.

(D) According to the structure of the shutter, there are the following effects:

As each panel is provided with the groove frame connected in the upper part of the frame, even if rainwater comes in along the horizontal surface through the gap in the jointing part of the respective panels, the rainwater will only remain within the groove of the groove frame but will not enter the container.

Even when the shutter is housed within the top plate and is held in a horizontal position, the groove frame will be held upward and therefore the rainwater remaining within the groove will not drop into the container.

(E) According to the mechanism for pulling up the shutter, there are the following effects:

As a pair of springs are provided in the directions intersecting rectangularly with the shutter moving direction, the extending stroke of the springs will not interfere with the shutter moving direction and will be able to be sufficiently taken. Therefore, the shutter moving distance can be taken to be long and the shutter can be pulled up deep into the top plate.

As a pair of springs are provided and are energized in the directions reverse to each other, the shutter can be pulled uniformly on both sides.

(F) As the side plate locking device is provided, even if there is an external load, the right and left side plates will not bend in the hinge parts and therefore the container will not be deformed.

According to the working mode of the locking device, there are the following effects:

When the wedge is struck in, the right and left side plates will interfere with the wedge and the wedge will prevent the right and left side plates from being folded. Therefore, even if an external force acts on the container, the container will not bend in the hinge parts and will be prevented from being deformed. When the wedge is pulled up, the right and left side plates will not interfere with the wedge, the case will be divided, the hinge part will be bendable and the container will be able to be folded.

What is claimed is:

1. A collapsible container provided with bendable right and left side plates and vertically movable front and back shutters between a top plate and bottom plate characterized in that reinforcing devices are removably provided respectively between the top plate and right and left side plates and between the bottom plate and right and left side plates, shutter locking devices are removably provided respectively between the front shutter and bottom plate and between the back shutter and bottom plate, side plates locking devices are removably provided respectively as opposed to the bending parts of the right and left side plates and a pair of springs energized in the directions reverse to each other and directed in the directions intersecting rectangularly with the shutter moving direction are provided within the top plate so that the shutters are always pulled toward the top plate with said pair of springs.

2. A collapsible container according to claim 1 wherein said reinforcing devices comprise extendable braces removably pivoted at the base ends to the respective corners between the top plate and right and left side plates and between the bottom plate and right and left side plates.

3. A collapsible container according to claim 2 wherein each brace comprises a hollow long frame and a locking frame extendably inserted into said long frame, a handle is rotatably pivoted to said long frame, a link is pivoted at one end to said locking frame and at the other end to said handle and a hook is provided at the end of said locking frame.

4. A collapsible container according to claim 1 wherein each shutter locking device comprises a locking pin provided in the lower part of the shutter and a hook rotatably borne on the bottom plate.

5. A collapsible container according to claim 1 wherein said right and left side plates each comprising two upper and lower plates can be bent inward through hinge parts and the side plate locking device opposed to said hinge part cmprises two cases fitted respectively to the sides of the upper and lower plates and a wedge vertically movably inserted into the respective cases.

6. A collapsible container according to claim 1 characterized in that each shutter comprises many bendably connected panels, each panel is provided in the upper part of the frame with a horizontal surface and a groove frame connected with said horizontal surface and in the lower part of the frame with an inside groove frame and a horizontal plate connected with said groove frame, said groove frame in the lower panel is opposed to the lower surface of said horizontal plate of the upper panel and the horizontal surface of the upper panel is contacted with the lower surface of the groove frame of the lower panel.

7. A collapsible container according to claim 6 wherein said groove of the groove frame will be directed in the horizontal direction when the shutter is in a vertical position and will be directed in the vertical direction when the shutter is housed within the top plate and is in a horizontal position.

8. A collapsible container according to claim 1 wherein said shutters are provided respectively on the front side and back side and two pairs of springs to pull up the respective shutters are provided within the top plate.

9. A collapsible container according to claim 1 wherein a pair of right and left brackets are provided within the top plate, two parallel spring guides are provided between the respective brackets and springs energized in the directions reverse to each other are extendably inserted in said two spring guides.

10. A collapsible container according to claim 8 wherein a pair of right and left brackets are provided within the top plate, two parallel spring guides are provided between the respective brackets and springs energized in the directions reverse to each other are extendably in said two spring guides.

* * * * *